United States Patent [19]

Aurand et al.

[11] 4,354,074

[45] Oct. 12, 1982

[54] ALTERNATE ACTION MECHANISM

[75] Inventors: Kenneth C. Aurand; Ralph J. Schneider, both of Freeport; Gale R. Turner, Orangeville, all of Ill.

[73] Assignee: Honeywell Inc., Minneapolis, Minn.

[21] Appl. No.: 279,410

[22] Filed: Jul. 1, 1981

[51] Int. Cl.[3] ..... H01H 13/56

[52] U.S. Cl. ..... 200/153 J

[58] Field of Search ..... 200/153 J, 328, 323

[56] References Cited

U.S. PATENT DOCUMENTS 3,962,556 6/1976 Kravchuck ..... 200/153 J

FOREIGN PATENT DOCUMENTS 2373863 8/1978 France ..... 200/328

*Primary Examiner*—John W. Shepperd

*Attorney, Agent, or Firm*—Charles L. Rubow

[57] ABSTRACT

An alternate action mechanism is disclosed in which a plunger carrying a cardioid multilevel cam is telescopingly mounted in a housing carrying a cam follower in the form of an inward projection on a removable C-shaped collar which is positioned in an annular channel on the housing.

13 Claims, 10 Drawing Figures

ALTERNATE ACTION MECHANISM

BACKGROUND OF THE INVENTION

The invention disclosed herein relates generally to linear motion mechanisms of the type in which successive operations of a plunger alternately cause the plunger to be latched at and released from a latched position, and more particularly, to a compact, low profile electrical switch actuator which is convertible between momentary and alternate action.

Manual keyboards, such as used in office machines, computer terminals and other manually controlled electronic installations commonly require switches having at least two types of switch actions. One type of switch, known as an alternate action switch, operates such that a first depression of the switch actuator or key causes the switch to be actuated to an "on" state, and to remain in that state. A second depression of the switch actuator or key releases the switch and returns it to an "off" state.

The proliferation of apparatus requiring switches for use in keyboards and other switch arrangements has placed increasingly stringent requirements on switches and switch actuators. Keyboard type switches are required to operate reliably over a long life, commonly involving millions of switching cycles. At the same time, the manufacture and sale of switches and switch actuators is highly competitive. Therefore, it is necessary that any alternate action mechanism used in significant quantities be designed for simple manufacture at a minimum additional cost over other types of switches. Among other things, the cost restriction essentially dictates a design which utilizes a minimum number of easily assembled parts.

It is also desirable that an alternate action switch be constructed so that it can be converted to momentary action by a simple modification or adjustment that does not require significant disassembly of the switch or removal of the switch from the panel in which it is mounted. Finally, keyboard designs have largely standardized on key spacing of 0.75 inches center to center, and the trend is toward increasingly low profile keyboard assemblies. Aesthetically, it has been found desirable for keyboard keys to have a somewhat square configuration such that an array of keys substantially completely covers the underlying support panel, and to have sufficient apparent depth to conceal mechanisms other than the key tops mounted thereon. This has been accomplished with a key cap design having a substantially square top with a flaired skirt. In order to meet the low profile requirement any actuator mechanism must fit within the skirt when the key cap is depressed. The fixed spacing and low profile requirements limit the space available for switch actuator mechanisms, including those for achieving alternate action operation. Consequently, such mechanisms must be exceptionally compact.

A variety of mechanisms for achieving alternate action switch operation have been devised. In general, a common feature of these mechanisms is the use of a multi-level cam track or surface on a first major part which is movable relative to a second major part. The second major part carries a cam follower which rides in the cam track. The cam track is typically cardioid or heart shaped in configuration. Operation requires relative movement between the cam track and cam follower both side to side and toward and away from one another. In some designs, the cam follower is biased to a predetermined side to side position. Such a design requires fewer (typically a minimum of two) different levels of the cam track. In other designs in which the cam follower is permitted unbiased side to side motion, more cam track levels (typically at least four) are required.

Various somewhat conflicting design criteria arise in attempting to shrink conventional alternate action mechanisms to fit within the space available on a low profile keyboard, while maintaining long life, reliable operation and low cost. For example, the cross section of the cam follower should be reasonably large to provide adequate stiffness and to minimize stress and wear on the cam surface. However, since the overall width of the cam track may be at least three times the diameter of the cam follower, the follower diameter is limited by the size of the part containing the cam track. Limiting the overall width of the cam track is also desirable from the viewpoint of limiting side-to-side excursions required of the follower and attendant problems in reliably providing for such excursions.

Similarly, deeper cam tracks and steps between adjacent levels generally provide for more reliable operation. However, deeper tracks also require both more uncommitted space in which to form the tracks and more clearance for in-out movement of the cam follower. In addition, deeper tracks necessitate the use of steeper ramps which result in greater operating stresses, and the use of follower biasing springs having longer effective lengths to achieve acceptable biasing forces throughout the longer follower movements.

Although a significant number of different alternate action mechanism designs are known, none of them embody all of the features and characteristics desired for present keyboard switch applications. One representative prior alternate action arrangement is disclosed in U.S. Pat. No. 2,956,446 issued to A. Ensign, Jr., et al on Oct. 18, 1960. The arrangement of this patent employs a cam track formed in a tubular segment rotatably carried on a driver member which slides within a housing. The housing carries a metal guide pin which rides in the cam track. The guide pin is mounted for in-out movement only. A leaf spring which extends parallel with direction of movement of the driver member is provided for inwardly biasing the guide pin. Relative side to side motion is provided by oscillation of the tubular segment on the driver member. Such an arrangement concentrically requires a driver shaft which is big enough to provide adequate strength, surrounded by a tubular segment which is thick enough to accommodate a cam track of adequate depth, surrounded by a housing. Outside the housing there must be adequate clearance for operation of the guide pin. The minimum feasible size of such an arrangement both in cross section and height is too large to meet present low profile keyboard requirements. Finally, the design requires a relatively high parts count which adds to manufacturing complexity and cost.

Another representative prior design is shown in U.S. Pat. No. 3,824,362 issued to G. Bury on July 16, 1974. This patent discloses an alternate action switch mechanism having a molded plastic plunger with a cam slot formed in the side thereof. A housing in which the plunger is mounted has a hole through the wall thereof adjacent the cam slot. A rectangular wire form cam follower is employed. The follower is configured as a rectangle with a portion of one side removed to provide two fingers directed toward one another. One of the fingers is inserted into a dimple in the housing opposite the hole through the wall thereof, and is free to pivot therein. The other finger extends through the hole to engage the cam on the plunger. The cam engaging finger is free to move in and out and oscillate from side to side to follow the cam. In such an arrangement in which a metal cam follower rides on a plastic cam surface, care must be exercised in configuring and finishing the parts to avoid excessive wear and/or gouging of the cam surface.

Yet a further prior design is shown in U.S. Pat. No. 4,001,526 issued to H. Olson on Jan. 4, 1977. This design is relevant because it employs a plastic cam follower molded on the end of a plastic leaf spring. The leaf spring extends parallel with the direction of movement of a plunger of which it is part. Thus, the arrangement is not well adapted to low profile apparatus. Also, as in connection with the Ensign arrangement the leaf spring is designed to permit movement of the cam follower in only one plane. Separate provisions are required for relative movement of the cam track and cam follower toward and away from one another.

The applicants have provided a unique alternate action mechanism of exceptionally simple design constructed of a minimum number of molded plastic parts. The cam surface is formed in the plunger to minimize space requirements while maximizing the amount of material in the plunger shaft to maximize strength. The follower and follower biasing means are molded in the form of a unitary C-shaped collar which is removablely carried in a channel on the housing. The collar configuration permits both side-to-side and in-out follower movement and provides for a very compact mechanization so as to facilitate a low profile keyboard arrangement.

SUMMARY OF THE INVENTION

The present invention is a compact alternate action mechanism comprising an inner member carrying a cam track telescopingly mounted in an outer member for movement relative thereto along an axis between first and second terminal positions. The inner member is biased toward the first terminal position. A C-shaped collar having a cam follower for engaging the cam track is carried in an annular channel on the outer member. The cam track and follower cooperate such that successive actuations of the inner member beyond the second terminal position alternately cause the inner member to be latched at and released from the second terminal position. The collar may be configured for easy removal from the channel to provide for momentary action.

DESCRIPTION OF THE PREFERRED EMBODIMENT

Figure 1:
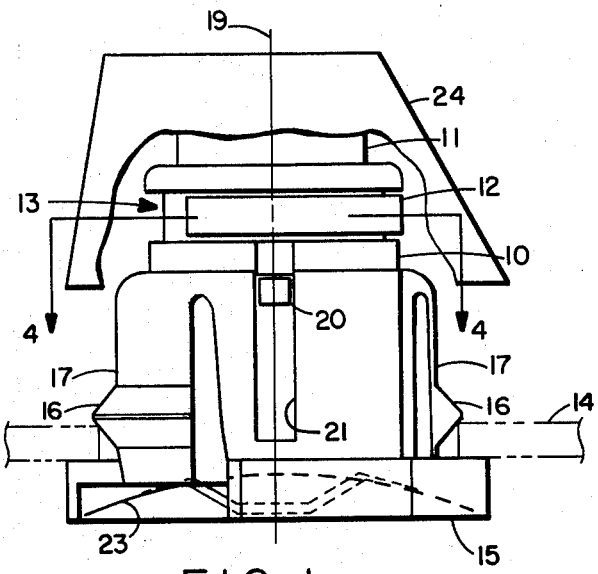
FIG. 1 is a side view of a low profile switch actuator in accordance with the applicants' invention having key cap thereon which is partially broken away.
Figure 3:
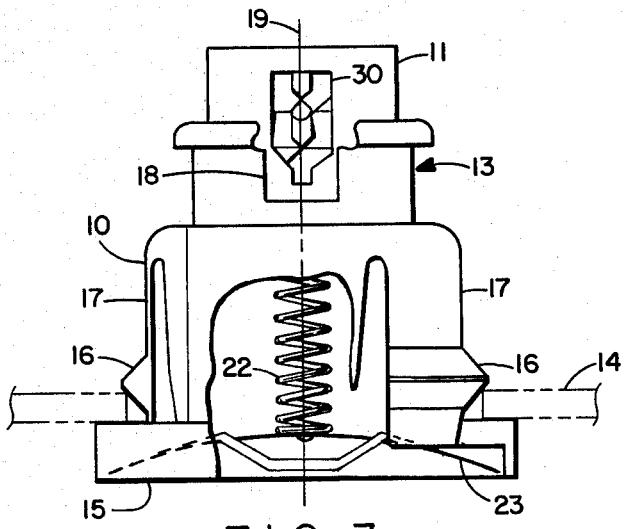
FIG. 3 is a side view of the switch actuator of FIG. 1 taken at right angles to the view of FIG. 1 without the key cap and collar, and partially broken away to show a cam track and spring bias means utilized in the actuator.

In FIGS. 1 and 3, reference numeral 10 identifies a housing of an alternate/momentary action switch actuator in accordance with the applicants' invention. Other elements of the actuator include a plunger 11 which is telescopingly mounted in housing 10 and a C-shaped collar 12 which is carried in a channel 13 in an outer surface of a wall of the housing. The wall also has an aperture 18 therethrough between the channel and a bore in the housing in which the plunger is mounted. Housing 10, plunger 11 and collar 12 are each preferably of molded plastic construction.

A keyboard array of actuators is commonly mounted in a supporting panel shown in broken lines and identified by reference numeral 14. At least the base of the illustrated housing is generally square, and is designed for installation in a square hole. For mounting purposes, housing 10 is formed with a flange 15 which is held in place against the lower surface of panel 14 by a pair of projections 16 on opposite corners of the housing above the panel. Each of projections 16 is a part of a resilient arm 17 on the housing. Thus, housing 10 may be inserted through a mounting hole in panel 14, and snapped in place as projections 16 pass through the panel.

As illustrated in FIGS. 1 and 3, the actuator is configured for use with an electrical switching element in the form of a variable capacitor. A variable capacitor array suitable for use in a keyboard employing such actuators is the subject of a pending U.S. patent application entitled "Environmentally Sealed Variable Capacitance Apparatus", Ser. No. 259,301, filed Apr. 29, 1981 in the name of T. Y. Chai et al, and assigned to the same assignee as the present application.

Plunger 11 is movable relative to housing 10 along an axis identified by reference numeral 19 between a first terminal position in which the plunger is extended and a second terminal position in which the plunger is depressed. The first terminal position may be fixed by tabs 20 on the plunger which slide in channels 21 in the housing. Plunger 11 is biased toward the first terminal position by a spring 22 and a snap action element 23. Snap action element 23, which will be described in greater detail hereinafter, may be held in a shallow cavity in the base of housing 10 by means of small projections around the periphery of the cavity. Spring 22 is compressed between a surface of plunger 11 and snap action element 23.

Plunger 11 is fitted with a key cap 24 having an upper surface which is configured to facilitate manual actuation. Key cap 24 may be mounted on plunger 11 by an arrangement which permits either of two angular orientations between the upper surface of the key cap and the axis of the plunger.

Figure 7:
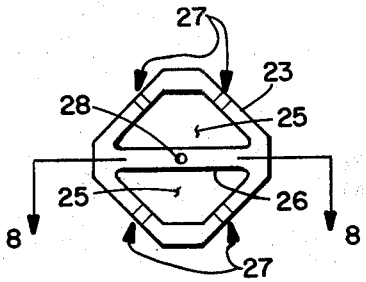
FIG. 7 is a plan view of a snap action element utilized in the actuator shown in FIGS. 1 and 3.
Figure 8:
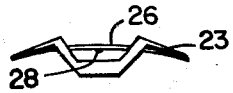
FIG. 8 is a side view of the snap action element shown in FIG. 7 in its unactuated condition.
Figure 9:
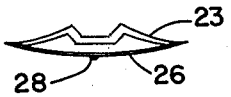
FIG. 9 is a side view of the snap action element of FIG. 7 in its actuated condition.

As shown in FIGS. 7–9, snap action element 23 is formed of a generally square thin spring metal blank of which portions identified by reference numeral 25 have been removed, leaving a diagonal center web 26. The blank is then crimped as shown at 27 to result in the profile shown in FIG. 8. A dimple 28 is formed in the center of web 26 for purposes which will hereinafter be described. In its normal state, snap action element 23 has the profile shown in FIG. 8. However, if a sufficient force is applied to web 26, as by spring 22 when plunger 11 is depressed, snap action element 23 snaps to the profile shown in FIG. 9. In this profile, dimple 28 slightly depresses an area on the surface of the previously mentioned capacitor array, thus changing the capacitance of a particular capacitor and providing an output signal as described in the above identified Chai et al patent application.

Spring 22 and snap action element 23 are matched so that when plunger 11 is in its unactuated position the spring does not apply enough force to cause the element to snap to the profile shown in FIG. 9, or to maintain it in that profile. However, when plunger 11 is depressed, spring 22 does supply sufficient force to result in reconfiguration of the snap action element as shown in FIG. 9. Accordingly, spring 22 serves both to bias plunger 11 to its unactuated or first terminal position and to transmit force from plunger 11 to snap action element 23. Spring 22 in combination with element 23 provides a non-linear force-displacement and tactile characteristic to operation of plunger 11. Although a particular arrangement for achieving the desired tactile characteristic is shown, it should be noted that any of a number of non-linear or snap action element configurations and/or spring combinations will also provide the desired feel.

Figure 2:
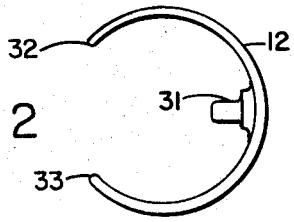
FIG. 2 is a plan view of a unitary C-shaped collar and cam follower utilized in the actuator of FIG. 1.

Plunger 11 may be maintained in a depressed or second terminal position by a cam track generally identified by reference numeral 30 in cooperation with a cam follower on collar 12. The cam follower can best be seen in FIG. 2 where it is identified by reference numeral 31. Cam follower 31 is in the form of an inwardly projecting post on collar 12, and is located between extremities 32 and 33 of the collar. The post and collar are preferably molded as a unitary part. When in place in channel 13 on housing 10, the collar and cam follower are free to oscillate about axis 19 as required for follower 31 to ride in cam track 30.

Figure 4A:
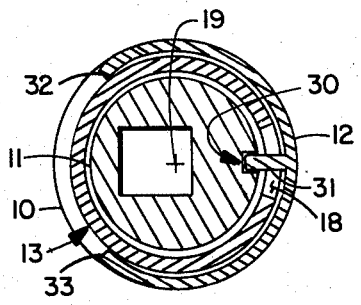
FIG. 4A is a sectional view of the actuator of FIG. 1 taken along line 4—4 with the actuator plunger at a first of two terminal positions.
Figure 4B:
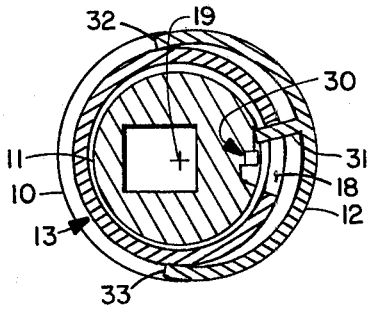
FIG. 4B is a sectional view of the actuator of FIG. 1 taken along line 4—4 with the plunger between the terminal positions.

In FIGS. 4A and 4B, the end of axis 19 is shown in the center of the illustrated view. Channel 13 encircles axis 19, and collar 12 in channel 13 extends more than 180° around the axis. Extremities 32 and 33 of the collar cooperate with channel 13 so as to bias cam follower 31 toward cam track 30 in plunger 11. FIG. 4A illustrates cam follower 31 positioned as it would be with plunger 11 at its unactuated or first terminal position. As can be seen from a study of FIGS. 5 and 6, when plunger 11 is in this position, cam follower 31 is centered in aperture 18 through the wall of housing 10, and is riding on the deepest surface in cam track 30.

FIG. 4B illustrates plunger 11 and cam follower 31 positioned as they would be part way through a first depression of the plunger. As illustrated in 4B, collar 12 and cam follower 31 have rotated in a counter-clockwise direction from their positions in FIG. 4A. In addition, cam follower 31 is riding on the shallowest surface of the cam track. FIG. 4B illustrates how collar 12 permits both side to side or oscillatory motion of cam follower 31 about axis 19, and movement of the cam follower toward and away from the axis, while continuously biasing the cam follower toward the axis. The unique arrangement of collar 12 and channel 13 permits these functions to be accomplished with exceptionally simple and compact components which are well adapted for a low profile switch actuator. As will be more fully described in connection with FIGS. 5 and 6, cam track 30 in cooperation with cam follower 31 provides for alternate action. Collar 12 is also easily removed from channel 13 to provide for momentary action of the actuator.

Figure 5:
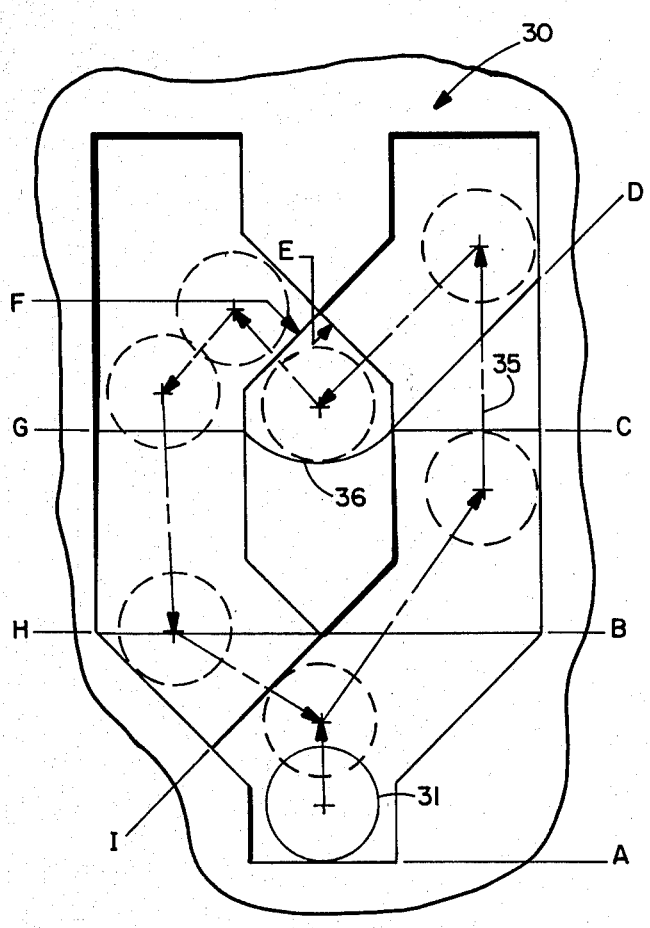
FIG. 5 is an enlarged plan view of the cam track shown in FIG. 3.
Figure 6:
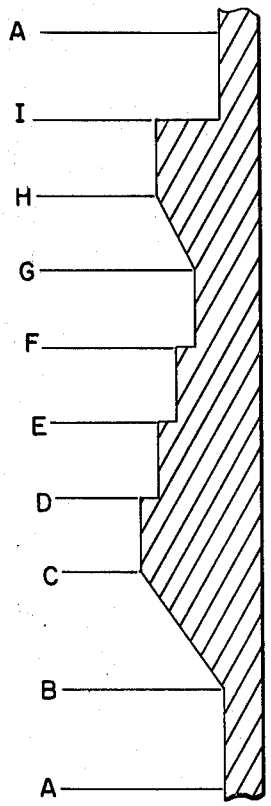
FIG. 6 is an illustration of the profile of the cam track along the center line thereof.

In the plan view of cam track 30 shown in FIG. 5, the path followed by cam follower 31 throughout a complete cycle is shown by broken line 35. The lines marked as stations A–I, each represent a change in slope and/or depth of the cam track. The stations are similarly identified in the track profile shown in FIG. 6.

In operation, depression of plunger 11 causes cam track 30 to move relative to cam follower 31 along axis 19. From an initial unactuated position at station A, a step at station I guides follower 31 to the right, and as the follower passes station B a ramp between stations B and C lifts the follower onto a plateau between stations C and D. At station D the follower drops into a deeper portion of the cam track bounded by a step at station D. Movement of plunger 11 in the same direction may continue until tabs 20 on the plunger reach the end of channels 21 in the housing. Upon release of the plunger by the operator, a step at station D guides follower 31 to the left, whereupon at station E it drops into a deeper portion of the cam track, and comes to rest against a wall 36 of the cam track. In this position, plunger 11 is latched at an actuated or second terminal position.

Upon the next depression of plunger 11, a step at station E guides follower 31 further to the left, whereupon at station F it drops into a still deeper portion of the cam track. Again, plunger 11 may continue to move in the same direction until it is stopped by the action of tabs 20 in channels 21. Upon release of the plunger by the operator, a step at station F guides the cam follower still further to the left. At station G the follower is lifted by a ramp between stations G and H onto a plateau between stations H and I. After the follower passes station I, it drops back to the same elevation it had on the cam track at station A. Subsequent actuations of the plunger result in a repetition of the previously described operation, and alternate latching at and release of the plunger from its second terminal position.

In accordance with the foregoing description, the applicants have provided a unique linear motion mechanism and switch actuator which is convertible between alternate and momentary action. This operation is provided through cooperation of a minimum number of simple parts in an exceptionally compact arrangement which is ideally adapted for low profile keyboard assemblies.

Although a particular embodiment has been shown and described for illustrative purposes, a number of variations and modifications will be apparent to those familiar with the relevant arts. It is intended that coverage of the invention not be limited to the embodiment shown, but only by the terms of the following claims.

The embodiments of the invention in which an exclusive property or right is claimed are defined as follows:

1. In an alternate action mechanism of the type having an inner member telescopingly mounted in an outer member for movement relative thereto along an axis between first and second terminal positions and biased toward the first terminal position, the inner member having a cam track adapted to cooperate with a cam follower carried by the outer member and constrained from movement relative thereto along the axis, cooperation of the cam track and cam follower being such that successive actuations of the inner member beyond the second terminal position alternately cause the inner member to be latched at and released from the second terminal position, movement of the inner member relative to the outer member requiring oscillation of the cam follower transverse to the axis, the improvement which comprises:

an annular channel in the outer member encircling the axis; and a C-shaped collar having a pair of extremities and an inwardly projecting cam follower between the extremities, said collar being configured to be positioned in said annular channel and the extremities thereof being configured to cooperate with the outer member so as to bias the cam follower toward the axis so that the cam follower engages the cam track, whereby said collar is permitted to oscillate about the axis as required for the cam follower to follow the cam track.

2. The mechanism of claim 1 wherein:

said annular channel is in an outer surface of the outer member at substantially the same location along the axis as the cam track in the inner member;

an aperture is provided through a wall of the outer member at the location of said annular channel and the cam track on the inner member; and the cam follower on said C-shaped collar extends through the aperture in the wall of the outer member to engage the cam track on the inner member.

3. The mechanism of claim 1 or 2 wherein said C-shaped collar is formed of a resilient material and is configured so that the extremities thereof extend more than 180° around the axis when said collar is positioned in said annular channel, whereby positioning of said collar in said annular channel provides for alternate action of the inner and outer members and removal of said collar provides for momentary action of the inner and outer members.

4. The mechanism of claim 3 wherein at least the portion of the inner member bounding the cam track and the cam follower are formed of plastic.

5. The mechanism of claim 4 wherein said C-shaped collar including the cam follower is of unitary molded construction.

6. An alternate action switch actuator comprising:

a housing having a wall bounding a cylindrical bore which extends along an axis, an annular channel in an exterior surface of the wall, said annular channel encircling the axis, and an aperture through the wall between a portion of the annular channel and the bore;

a plunger slideably mounted in the bore for reciprocal movement along the axis between first and second terminal positions, said plunger carrying a cam track adjacent the aperture in the wall of said housing;

bias means for biasing said plunger toward the first terminal position; and a resilient C-shaped collar positioned in the channel in the wall of said housing, said collar having a pair of extremities and an inwardly projecting cam follower between the extremities adapted to engage the cam track on said plunger, the extremities of said collar being configured to cooperate with said housing so as to bias the cam follower toward the axis, the cam track and cam follower cooperating to latch said plunger at the second terminal position upon a first depression of said plunger, and to release said plunger from the second terminal position upon a second depression of said plunger.

7. The switch actuator of claim 6 wherein said C-shaped collar is removable from the channel in the wall of said housing whereby the switch actuator is convertible between alternate and momentary action by positioning said collar in the channel or removing it therefrom.

8. The switch actuator of claim 7 wherein the extremities of said C-shaped collar extend more than 180° around the axis.

9. The switch actuator of claim 6, 7 or 8 wherein at least the portion of the plunger which bounds the cam track and the cam follower are formed of plastic.

10. The switch actuator of claim 9 wherein said C-shaped collar including the cam follower is of unitary molded construction.

11. A linear motion mechanism convertible between momentary and alternate action comprising:

a housing;

an inner member telescopingly mounted in said housing for movement relative thereto along an axis between first and second terminal positions, but restrained from rotation relative thereto about the axis;

bias means for biasing said inner member toward the first terminal position;

a cam track carried by said inner member and adapted to cooperate with a cam follower carried by said housing and constrained from movement relative thereto along the axis, such that successive depressions of said inner member beyond the second terminal position alternately cause said inner member to be latched at and released from the second terminal position, movement of said inner member relative to said housing requiring oscillation of the cam follower transverse to the axis;

an annular channel in an outer surface of said housing encircling the axis at substantially the same location along the axis as the cam track on said inner member; and a resilient C-shaped collar removablely mounted in said annular channel, said collar having a pair of extremities which extend more than 180° around the axis and an inwardly projecting cam follower between the extremities, the cam follower being configured to engage said cam track, and the extremities of said collar being configured to bias the cam follower toward said cam track so as to provide for alternate action in response to successive actuations of said inner member, removal of said C-shaped collar from said annular channel providing for momentary action in response to actuation of said inner member.

12. The mechanism of claim 11 wherein at least the portion of said inner member which bounds said cam track and the cam follower are formed of plastic.

13. The mechanism of claim 11 or 12 in which said C-shaped collar including the cam follower is molded in unitary form.

* * * * *